United States Patent [19]

Trettin

[11] Patent Number: 4,861,042

[45] Date of Patent: Aug. 29, 1989

[54] REPLACEABLE NET FOR LACROSSE STICK

[76] Inventor: Douglas F. Trettin, 714 Southern Hills Dr., Arnold, Md. 21012

[21] Appl. No.: 255,492

[22] Filed: Oct. 11, 1988

[51] Int. Cl.[4] ..... A63B 59/02

[52] U.S. Cl. ..... 273/326

[58] Field of Search ..... 273/326, 73 R, 73 A, 273/73 D

[56] References Cited

U.S. PATENT DOCUMENTS 3,507,495 4/1970 Tucker et al. ..... 273/326

*Primary Examiner*—William H. Grieb

*Attorney, Agent, or Firm*—Walter G. Finch

[57] ABSTRACT

A method and apparatus is disclosed for providing a replaceable pocket netting for a damaged lacrosse stick. The weaving lacing process of this invention is similar to the traditional pocket methods for maintenance of lacrosse stick. The button system is used on the leather thongs so that the pocket and its integrity can be salvaged from a broken lacrosse stick and used again with little effort. To take out this invention from the head of a lacrosse stick in which the pocket can be removed, it is necessary to untie and remove the side wall strings, untie shooting (throw) string at single hitch knot and at the correction attachment, untie the leather thongs at the bottom of the head. Then the pocket may now be removed from the unwanted head. To re-use the invention, it is necessary to rebutton the leather thongs at the top of the head, then the side wall strings and shooting string are applied. Finally, the leather thongs are retied at the base of the head at a desired pocket depth.

7 Claims, 4 Drawing Sheets

REPLACEABLE NET FOR LACROSSE STICK

BACKGROUND AND SUMMARY OF THE INVENTION

This invention relates to sporting goods and more particularly to an improved lacrosse stick having a replaceable pocket netting.

A lacrosse stick is made of three basic components, namely a handle, a head, and a pocket. These components, if damaged in any way, can be replaced independently of each other.

There are two basic options in pocket style, namely mesh and traditional. The mesh pockets consist of a polyester material woven together to create a diamond mesh (much like a mesh gymnastic bag). This mesh material is machine made and is the integral body of the pocket.

On the other hand, traditional pockets consist of four (4) leather thongs, one (1) polyester lacing string, two (2) polyester side wall strings, and one (1) shooting (throw). These materials are woven or strung in the traditional manner to form a pocket. The stringing and/or weaving of a traditional pocket is very labor intensive and can only be done by hand (the process takes about one and a half hours).

The traditional style pocket was used when the Indians first started to play the game and lacrosse sticks were made of wood. Today, the traditional pocket is standard to the industry and is the most popular pocket among lacrosse players.

The traditional pocket can be strung by the few that know how to do it well. Those who do not have stringing skills often hire independents who do. Or, one can buy a head factory strung by the lacrosse manufacturer. If a lacrosse stick is purchased unstrung (without a pocket), then a stringing "kit" must be purchased. This kit includes material for weaving a traditional pocket.

A lacrosse player's pocket takes months to "break in". During this period, the player becomes accustomed to the pocket and makes adjustments to make it personalized. The pocket is the most crucial part of a lacrosse stick because it is the basis for good ball control, accurate passing, and fast, accurate shooting.

The head of a lacrosse stick is currently made of a moderately flexible plastic material. These heads often break due to weather conditions or the rough style of play that is lacrosse. It is known that a manufacturer would not make a head that would not break, for obvious economic reasons. If a plastic head, strung traditionally, breaks, the pocket cannot effectively be saved. The pocket has to be unstrung or the leather has to be cut at the top head to leather thong connection, rendering the pocket useless because it destroys the leathers.

THE PROBLEM FACING A LACROSSE PLAYER

When the head of a lacrosse stick, with the pocket strung by the standard method with traditional materials, namely two (2) side wall strings, four (4) leather thongs, one (1) shooting (throw) string, (1) lacing string, breaks, the existing traditional pocket cannot effectively be saved and used in a new head. Specifically, the leather thongs have to be unwoven from the lacing, thus destroying the pocket and its integrity.

The leather thongs often break due to use and/or age. Often, the thongs that break are the two that are cut at the base to accept a lacing string to leather thong connection. (This connection is the turning point at which one finishes a row of weaving or stringing, then continues the stringing process up another row. This connection keeps the "non-slip knots" from "creeping" up the leather thong and disforming the pocket.)

If one or both of these leather thongs breaks in a pocket strung traditionally, they cannot effectively be replaced. Specifically, the original lacing string to the bottom of the leather thong connection cannot effectively be recreated. The pocket has to be unstrung and the connection reformed. This takes time and skill. Often, the pocket is taken out completely and a new one is strung in its place, which also takes time, skill and money.

SOLUTION

Using the materials, namely two (2) side wall strings, four (4) leather thongs, one (1) shooting (throw) string, one (1) lacing string, and four (4) plastic/vinyl buttons, a pocket is strung in such a way that it can be taken out of one head (broken or unbroken) and put into a new head.

The weaving-lacing process of this invention is similar to the traditional pocket methods. However, a button system is used on the leather thongs so that the pocket and its integrity can be salvaged from a broken stick, a connecting attachment to the shooting string is used so the shooting string remains intact to the pocket as it is being replaced, and a new lacing string to leather thong connection allowing uniform leather replacement.

To take out this invention from a head, it is necessary to untie and remove the side wall strings, untie knot and correction attachment knot securing the shooting string to the lacrosse head, untie the leather thongs at the bottom of the head, and unbutton the leather thongs at the top of the head. The pocket may now be removed from the unwanted head.

To re-use the invention, it is necessary to rebutton the leather thongs at the top of the head, then apply the side wall strings and shooting string. Finally, the leather thongs are retied at the base of the head at a desired pocket depth.

The estimated time to change the netting from one head to another is approximately ten minutes and requires no great skill and involves no weaving process.

In summary, the whole pocket is replaceable and each component of the invention is also replaceable.

OBJECTS OF THE INVENTION

It is an object of this invention to provide a lacrosse stick having a replaceable netting.

Another object of this invention is to provide a method for replacing the traditional pocket of a lacrosse stick head with new netting.

And to provide an invention for an improvement to the netting of a traditional pocket of a head of a lacrosse stick is still another object of this invention.

To provide a novel leather thong system to a plastic head of a lacrosse stick is also an object of this invention.

And to provide a novel method and system for quickly replacing the damaged and/or defective netting of a lacrosse stick is still another object of this invention.

A further object of this invention is to provide a pre-strung pocket for a lacrosse stick.

And a further object of this invention is to provide a pre-strung pocket including a shortening string for a lacrosse stick.

DESCRIPTION OF THE PREFERRED EMBODIMENTS

Figure 1:
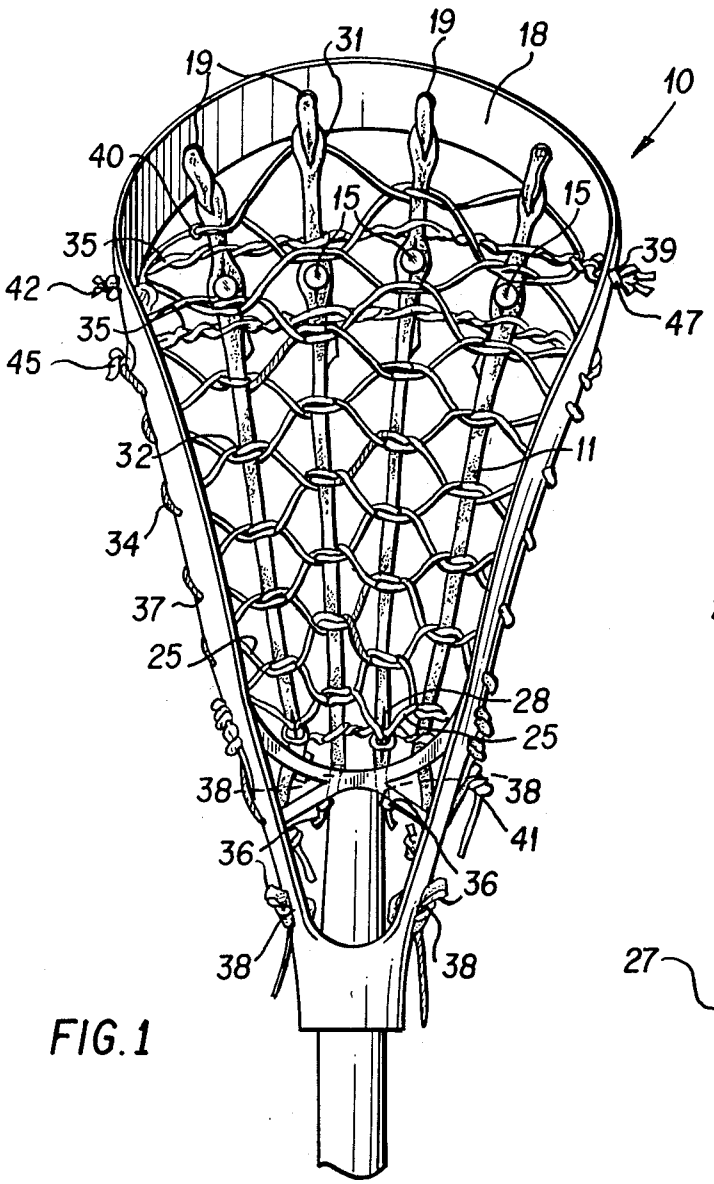
FIG. 1 is a front view of the head of a lacrosse stick.
Figure 5:
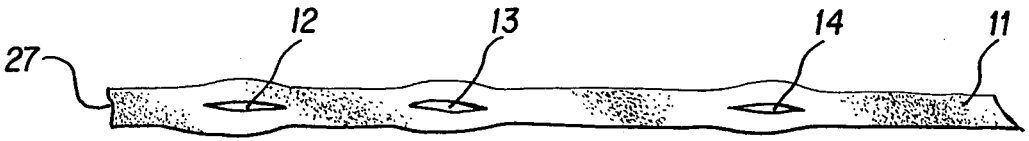
FIG. 5 is a front view of a new leather thong.
Figure 6:
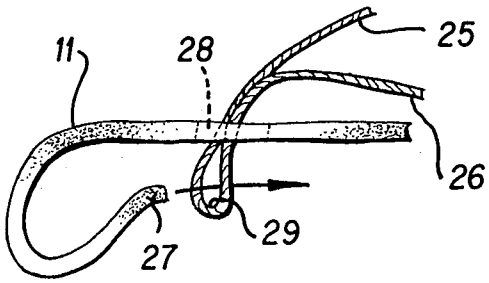
FIG. 6 illustrates a side view for stringing a net to a thong.
Figure 7:
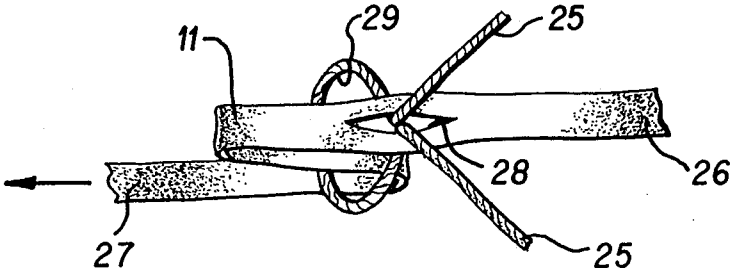
FIG. 7 is a plan view of a thong of FIG. 6.
Figure 8:
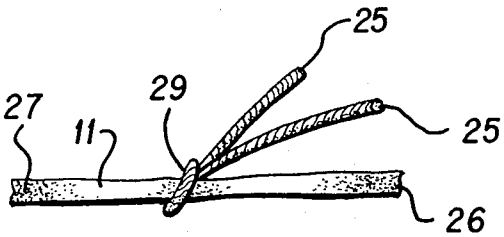
FIG. 8 is a side view of a thong.
Figure 9:
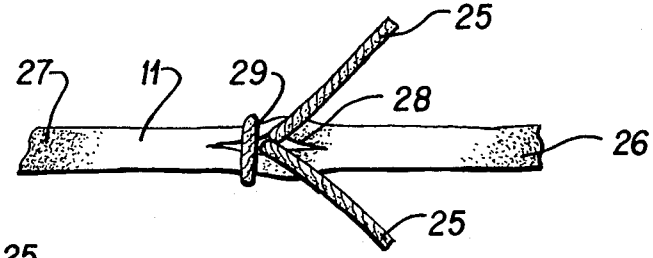
FIG. 9 is a plan view of a thong.
Figure 10:
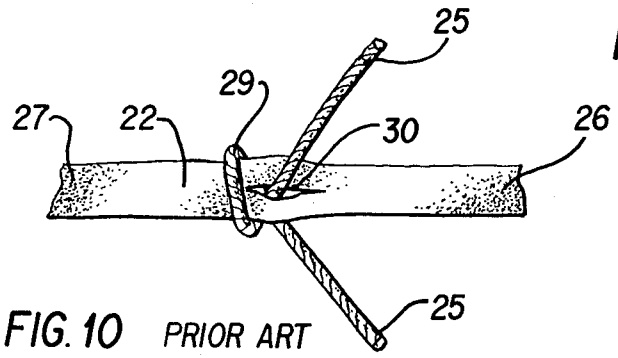
FIG. 10 PRIOR ART
FIG. 10 is a plan view of a prior art thong.

Referring now to FIG. 1 of the drawings, there is shown a head 10 of a lacrosse stick having a plurality of spaced leather thongs 11 extending generally in the longitudinal direction of the stick. Each leather thong 11 is provided with spaced apertures 12, 13, and 14 as best shown in FIG. 5.

Figure 4:
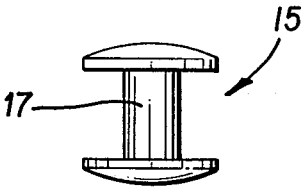
FIG. 4 is a front view (enlarged) of a plastic button.

A plastic vinyl button 15 having a shaft 17, as best shown in FIG. 4, is positioned in each leather thong 11 as best seen in FIG. 1. A series of spaced apertures 19 are provided in the wall of the plastic rim 18 of the lacrosse head 10 to hold the upper ends of the thongs 11 to the plastic rim 18 of the head 10.

The head 10 of the lacrosse stick is provided with netting 25 as shown in FIG. 1. In addition, alternate thongs 11 are provided with an aperture 28 at the lower end of the head 10 of the lacrosse stick.

Figure 2:
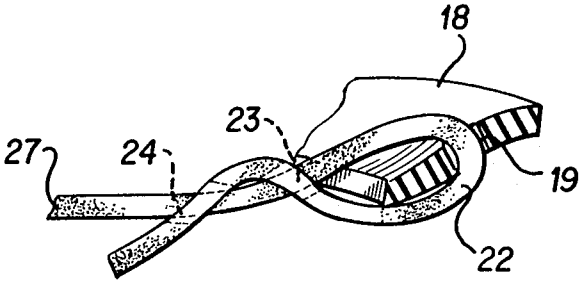
FIG. 2 PRIOR ART
FIG. 2 is a sectional view of a section of a lacrosse head showing the prior art.

Referring now to FIG. 2, there is illustrated a traditional or prior art thong 22 assembled to a lacrosse stick head 18. The thong 22 is passed through apertures 19, 23 and 24, with the ends 27 of the thong 22 being positioned towards the bottom 15 of the head 10, through apertures 38 shown in FIG. 1.

Figure 3:
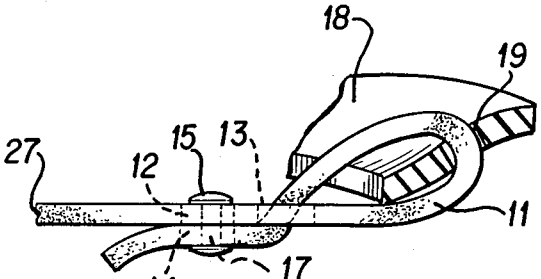
FIG. 3 is a sectional view showing a new method of attaching a leather thong to a plastic lacrosse head.

In FIG. 3, the leather thong 11 of this invention is shown assembled to the rim 18 having the aperture 19 provided therein so that the thong 11 passes through the aperture 19 and is held in position by the shaft 17 of the plastic button 15 after the apertures 12 and 14 are passed over the head of the button 15. The end 27 of the thong 11 is directed to the head 10 of the lacrosse stick.

Figure 11:
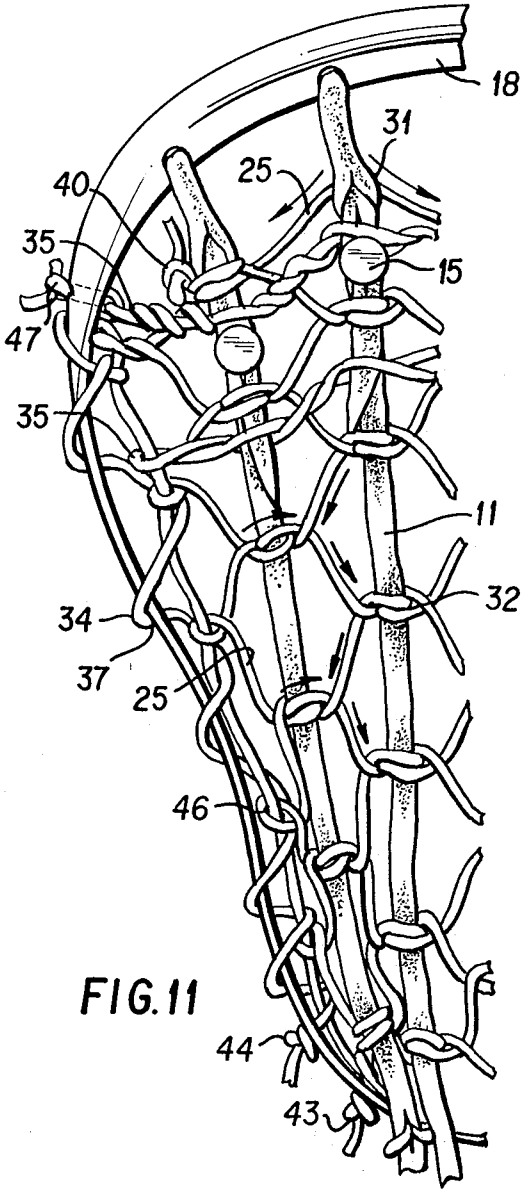
FIG. 11 shows a side view of a portion of a lacrosse head strung

The replaceable net for the lacrosse stick having the head 10 will now be described:

As shown in FIG. 11, the side wall strings 34 are attached, using apertures 37 shown in FIG. 11 provided by the lacrosse head manufacturer. A single hitch knot 43 is begun with as shown in FIG. 11, and the same knot 44 is ended with as shown also in FIG. 11.

Then, leather thongs 11 are attached using the system of buttons 15 shown in FIG. 3, to the apertures 19 at the top of the head, as shown in FIG. 1. Then, the leather thongs 11 are threaded through the apertures 38 at the base of the head provided by the manufacturer of the lacrosse head 10 in FIG. 1. The leather thongs 11 are then pulled tight. Then tie each leather thong off using a single hitch knot 36 of FIG. 1. The lacing process is now ready to begin.

Figure 16:
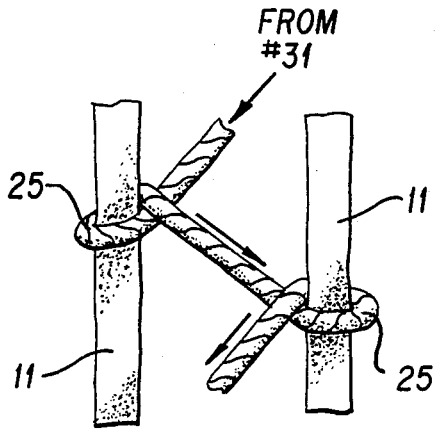
FIG. 16 shows spaced thongs being laced in this invention.

The lacing string 25 of FIG. 1 is fed through the loop at the leather thong 11 to the top of head connection 31 shown in FIGS. 1 and 11. The single adjacent thong 11 of FIG. 16 is laced down in evenly spaced intervals until the bottom of the lacrosse head 10 is reached. Then the lacing to the bottom of the leather thong connection is formed as shown in FIGS. 6, 7, 8, and 9.

Figure 14:
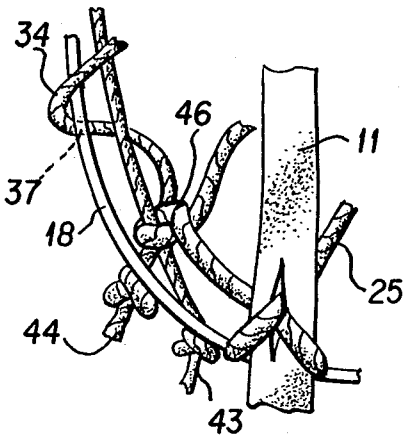
FIG. 14 shows a portion of a thong showing a lacing of this invention.
Figure 12:
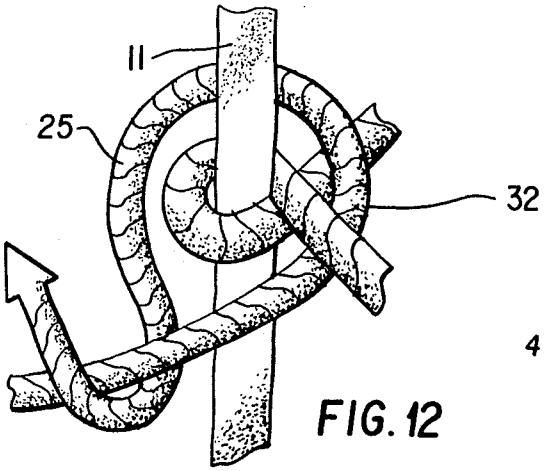
FIG. 12 shows the steps of making a non-slip knot of the invention.
Figure 13:
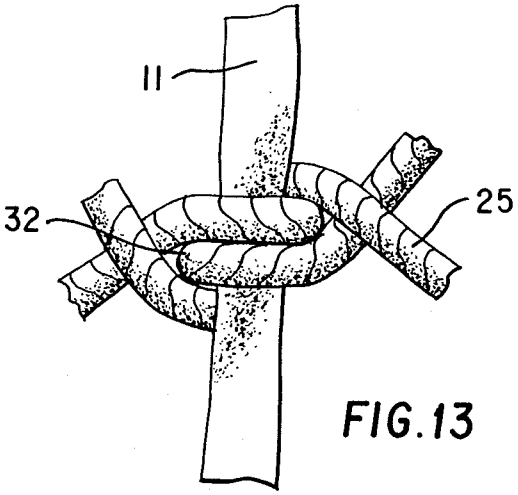
FIG. 13 is a plan view of a non-slip knot of the invention.

Then the leather thong 11, is strung up next to the side wall string, using the side wall string as a connecting point to the lacing string 46 as shown in FIGS. 11 and 14 as you string up the leather thong 11 next to the side wall string. An interwoven non-slip knot 32 is created as shown in FIGS. 1, 12, and 13.

When no more interwoven non-slip knots 32 can be made on that side, a single hitch knot is made at the top of the leather thong 11 next to the side wall string, after the last interwoven non-slip knot 40 is made, as shown in FIG. 11.

Then, repeat the stringing process from point 31 of FIG. 11, for the other side of the pocket, using the remainder of the lacing string and unused leather thongs 11 and unused side wall string. Finish off the lacing process by forming a single hitch knot to the side wall string at the base of the lacrosse head 10 after the last interwoven non-slip knot is formed, as shown by reference numeral 41 of FIG. 1.

Figure 15:
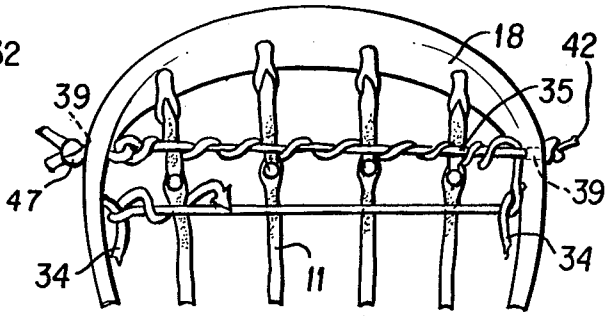
FIG. 15 shows a portion of a head of a lacrosse stick of this invention in being laced.

Next, put in the shooting string 35 of FIG. 1. Using apertures 39 provided by the manufacturer of the lacrosse head 10, a single hitch knot 42 of FIG. 15 is made. The shooting string weaving process continues by joining the shooting string 35 to the connection attachment 47 shown in FIG. 15 at apertures 39, after the second level of the shooting string 35 is completed. Then it is tied off to the side wall string 34 shown in FIG. 15 with a single hitch knot 45 indicated in FIG. 1. The shooting string weaving process is completed by joining another single hitch knot, tying off the shooting string 35 to the side wall string, as indicated by reference numeral 45, in FIG. 1. Finally, you have a fully strung lacrosse head 10 using the method described for FIGS. 1 to 5.

Accordingly, modifications and variations to which the invention is susceptible may be practiced without departing from the scope and intent of the appended claims.

What is claimed is:

1. A lacrosse stick having a head and a base and a pocket in said base, comprising, a plurality of spaced leather thongs positioned longitudinally in said head and said base, button means for buttoning the corresponding ends of each said spaced leather thong at the top of said head, the other ends of said spaced leather thongs being tied at a desired pocket depth at said base, wall strings and a throw string applied to the sides of said head.

2. A lacrosse stick having a head and a pocket as recited in claim 1, wherein each said button means includes a cylindrical shape having substantially flat heads on the opposite ends thereof.

3. A lacrosse stick having a head and a pocket as recited in claim 1, and additionally a netting interpositioned between said plurality of spaced leather thongs.

4. A kit for a replaceable pocket of a head of a lacrosse stick, comprising, a plurality of spaced leather thongs for longitudinally positioning in said head, wall strings, a throw string, means for fastening said throw string, said wall strings and said throw string being arranged to be applied to said head, each said spaced leather thong having first and second ends, and button shaped means for fastening the corresponding ends of said spaced leather thongs at the top of said head, with each button shape being formed of a cylinder with a pair of substantially flat heads on the opposite ends of said cylinder, the other ends of said spaced leather thongs being tied at the base of said head at a desired pocket depth.

5. A kit for a replaceable pocket of a head of a lacrosse stick as recited in claim 4, and additionally means for fastening of said leather thongs at said base of said head at a desired pocket depth.

6. A kit for a replaceable pocket of a head of a lacrosse stick as recited in claim 4, wherein said button means includes a cylindrical shape having substantially flat heads on the opposite ends thereof.

7. A kit for a replaceable pocket of a head of a lacrosse stick as recited in claim 4, and additionally a netting interpositioned between said plurality of spaced leather thongs.

* * * * *